US005924225A

United States Patent [19]

Hall et al.

[11] Patent Number: 5,924,225

[45] Date of Patent: Jul. 20, 1999

[54] IRON HAVING SKIRT WITH METAL PLATING

[75] Inventors: Stephen M Hall, Cheshire; John G. Rousso, Beacon Falls, both of Conn.

[73] Assignee: HP Intellectual Corp., Wilmington, Del.

[21] Appl. No.: 09/039,512

[22] Filed: Mar. 16, 1998

[51] Int. Cl.[6] ..... D06F 75/36; B05D 5/00; B05D 3/02

[52] U.S. Cl. ..... 38/88; 427/294; 427/372.2; 427/407.1

[58] Field of Search ..... 38/88, 93, 74, 38/77.83; 427/407.1, 385.5, 294, 299, 379, 372.2, 393.5, 437, 123; 106/1.18; 428/411.1, 414, 416, 423.1, 426.8

[56] References Cited

U.S. PATENT DOCUMENTS

| | | | |
|---|---|---|---|
| 3,650,803 | 3/1972 | Lin | 427/437 X |
| 3,930,807 | 1/1976 | Kobayashi et al. | 205/169 X |
| 4,115,935 | 9/1978 | Toft | 38/88 |
| 4,463,038 | 7/1984 | Takeuchi et al. | 427/407.1 |
| 4,656,763 | 4/1987 | Kawasaki et al. | 38/77.83 |
| 4,747,222 | 5/1988 | Riba | 38/77.7 |
| 4,761,337 | 8/1988 | Guagliardo et al. | 428/425.8 |
| 4,795,660 | 1/1989 | Cooray et al. | 427/123 |
| 5,273,789 | 12/1993 | Shinonaga et al. | 427/393.5 X |
| 5,441,626 | 8/1995 | Ogisu et al. | 205/167 X |
| 5,549,932 | 8/1996 | Ishidoya et al. | 427/385.5 |
| 5,834,555 | 11/1998 | Meisenburg et al. | 428/423.1 X |

FOREIGN PATENT DOCUMENTS

| | | |
|---|---|---|
| 35 23 669 | 5/1986 | Germany . |
| 42 31 398 | 1/1995 | Germany . |

*Primary Examiner*—Ismael Izaguirre
*Attorney, Agent, or Firm*—Barry E. Deutsch

[57] ABSTRACT

An iron having a housing with a skirt, a soleplate, and a heating element in the soleplate. The skirt has a molded body comprised of dielectric material. The body has a downwardly extending perimeter rim. A metal plating is adhered directly onto the rim to give an appearance of a metal skirt. The rim includes a base coat, the metal layer and a top coat. The base and top coats on the skirt being baked at particular temperatures and for particular amounts of time for curing and drying.

11 Claims, 3 Drawing Sheets

IRON HAVING SKIRT WITH METAL PLATING

BACKGROUND OF THE INVENTION

1. Field of the Invention

The present invention relates to irons and, more particularly, to an iron having an improved skirt.

2. Prior Art

Currently, irons produced by manufacturers who have the desire and/or need to have a metal/metalized looking skirt use what is known as a "shell" to achieve this look. This shell is typically a metal part which is stamped out in the configuration of the outer profile of the skirt. This shell is then placed over the plastic skirt and fastened by a number of different means and becomes the outer surface appearance. There are several limitations and/or disadvantages to this method. The stamping is typically limited to a very simplistic shape. Complex curves and angles of the skirt effectively limit the design of the stamping as is attributed by all the models currently available with a metal shell for a skirt. In each case, the industrial design of these shells is extremely simple. The stamped shell becomes an additional part which must be procured or fabricated and inventoried, thus increasing product cost. Tooling to fabricate the shell is also necessary and will need constant maintenance and periodic replacement; again increasing product cost. Dimensional fits between the shell and the skirt will always be a concern when you try to get two visual parts to align perfectly. Scrap and/or rework costs will increase as a result of this option. Secondary buffing operations that are necessary on some alternatives must be tightly controlled in order not to damage the coating, thus increasing scrap and costs. Black & Decker (U.S.) Inc. offers an iron for sale with a metal skirt (model F63D, The Classic Iron). In this iron the metal shell doubles as the actual skirt as well as an aesthetic, appearance item.

SUMMARY OF THE INVENTION

In accordance with one embodiment of the present invention, an iron is provided having a housing with a skirt, a soleplate connected to the housing, and means for heating the soleplate. The skirt has a molded body comprised of dielectric material. The body has a downwardly extending perimeter rim. The rim has a metal plating adhered directly onto the rim to give an appearance of a metal skirt.

In accordance with another embodiment of the present invention, an electric iron skirt is provided comprising a body and a coating. The body is made of molded dielectric material. The body has a first section and a second section. The coating is applied only to the second section wherein the coating is not applied to the first section.

In accordance with one method of the present invention, a method of manufacturing a skirt for an iron is provided. The method comprises steps of molding a skirt body from a dielectric material; and applying a coating to the skirt body.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
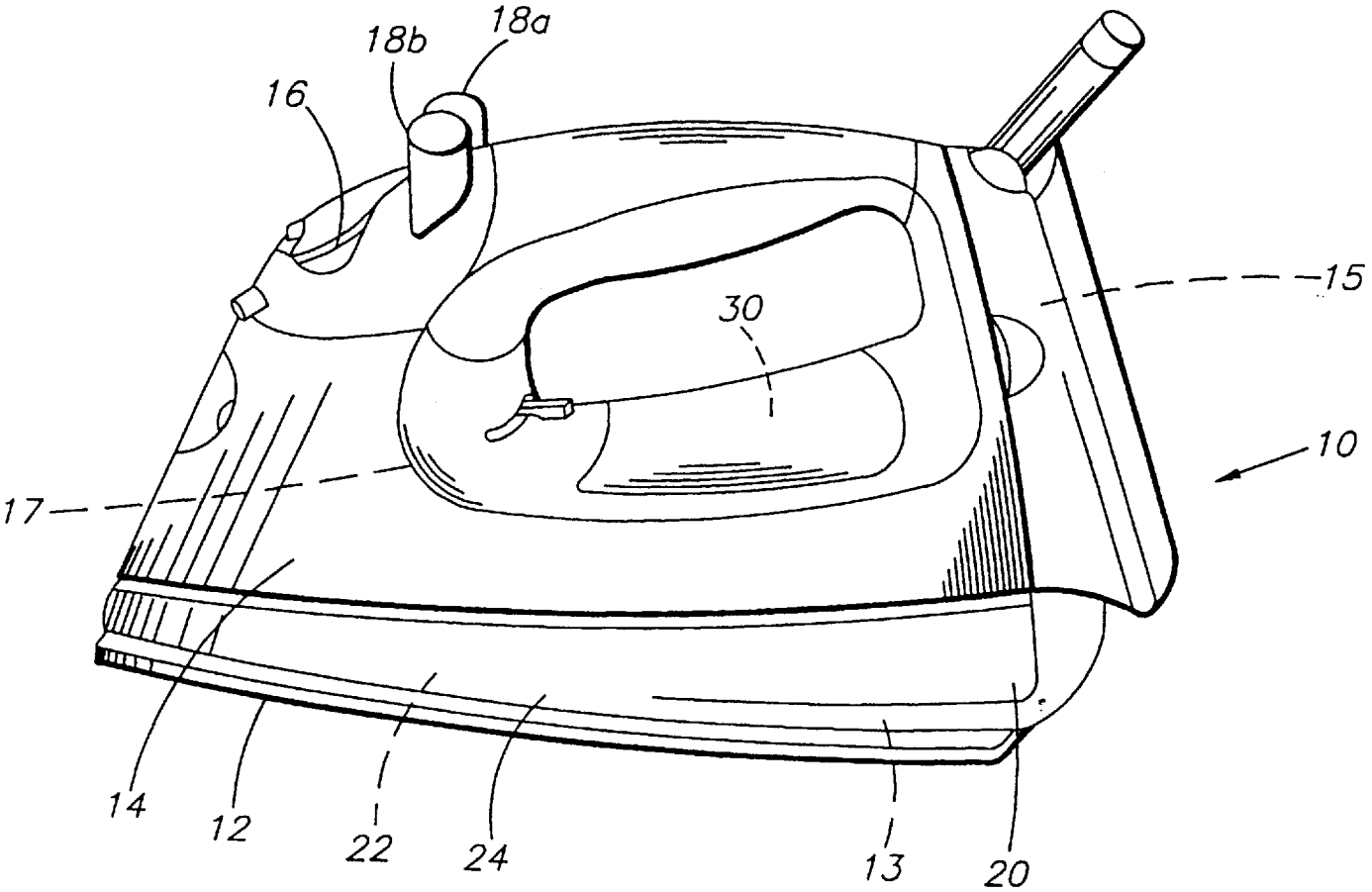
FIG. 1 is a perspective view of an iron incorporating features of the present invention.

Referring to FIG. 1, there is shown a perspective view of an iron 10 incorporating features of the present invention. Although the present invention will be described with reference to the embodiments shown in the drawings, it should be understood that features of the present invention may be incorporated into various different types of alternate embodiments of irons. In addition, any suitable size, shape or type of elements or materials could be used.

Figure 2:
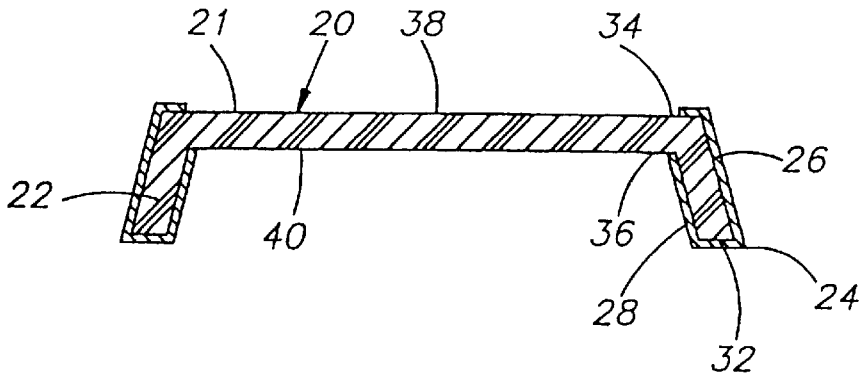
FIG. 2 is a cross-sectional view of the skirt shown in FIG. 1.

The iron 10 generally comprises a soleplate 12, a housing 14, a temperature control knob 16, a spray button 18*a* and a surge button 18*b*. The soleplate 12 includes a heating element 13 integrally molded therein. The heating element is electrically connected to electronic circuitry 15 in the rear of the iron and a thermostat 17 connected to the temperature control knob 16. The iron 10 further includes a skirt 20 that is located directly above the soleplate 12. Referring also to FIG. 2, a cross-sectional view of the skirt 20 is shown. The skirt 20 preferably comprises a one-piece body member 21 made of a molded high temperature plastic or polymer material which is also a dielectric. The body 21 has a downwardly extending perimeter rim 22 along its two elongate sides and its rear side. In the embodiment shown, the rim 22 has been plated with a chrome plating 24. The chrome plating 24 extends along the outside surface 26, the inside surface 28, and the bottom surface 32 of the rim 22. The chrome plating 24 is adhered directly to the body 21. As evident in FIG. 1, the top side 38 and bottom side 40 of the skirt body 21 are covered by the housing 14 and the soleplate 12, respectively. Thus, only chrome plated portions of the iron 22 are visible to the user.

The method of chrome plating preferably comprises a series of chemical cleaning steps whereby the plastic skirt body 21 is prepared for the chroming process. After the chemical cleaning steps are complete, a copper strike or layer is applied to substantially cover the entire body 21. Application of the copper layer on a plastic substrate is necessary to the chroming process in order to have the chrome permanently plated onto that surface. A laser is then used to scribe or burn lines through the copper layer, down to the body 21, at areas 34 and 36 on the top side and bottom side of the skirt. Thus, scribe lines are formed through the copper layer at areas 34 and 36. The chroming process is then accomplished by clamping electrodes on the copper at the rim 22 outside of the scribe lines. In the chroming process, chrome will be deposited only on those surfaces containing copper that are electrically connected to the electrodes (i.e.: that are on the outside of the scribed lines). The surfaces containing copper which are on the inside of the scribe lines at areas 34 and 36 are not electrically connected to the electrodes because of the electrical break at the scribe lines. The copper inside the areas 34, 36 are chemically etched away during the chroming process leaving only the plastic material of the body 21 again. This is along a majority of the top side 38 and bottom side 40 of the body 21.

The process of scribing and coating only selected areas is done for two reasons. First, by eliminating the copper in selected areas, such as the underside of the skirt, we eliminate the need for electrically insulating all the electrically conductive materials located beneath the skirt. This electrical insulation would be necessary since chrome is electrically conductive and there are regulatory requirements to maintain certain gaps between electrical/electrically conductive components. Since the scribing and subsequent chroming processes prevent any conductive material from getting where you do not want it, you eliminate the need for costly electrical insulation. Second, by eliminating the copper in selected areas, such as the top and bottom of the center section of the skirt where it is not visible to the consumer, you eliminate additional chrome material. Thus, the cost is reduced. The result of the chroming process on the plastic skirt body is a completed one-piece part void of any need for secondary operations.

This invention has several advantages. It eliminates the need for a metal/metallic shell to provide a highly polished surface. It adds no additional costs for tooling. It allows for complex shapes of the skirt since the plating is adhered directly to the skirt body. Dimensional fit issues are non-existent since the plating is extremely thin and is applied directly to the skirt. No secondary buffing operations are necessary.

Figure 3:
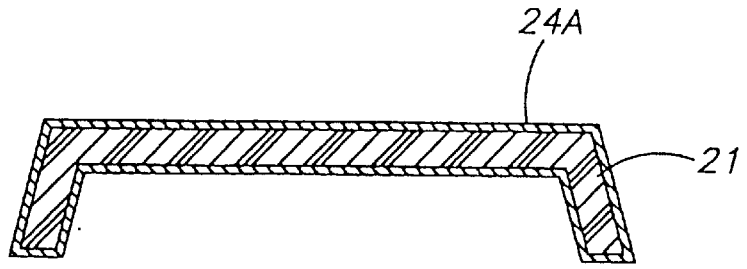
FIG. 3 is a cross-sectional view similar to FIG. 2 of an alternate embodiment of a skirt.
Figure 4:
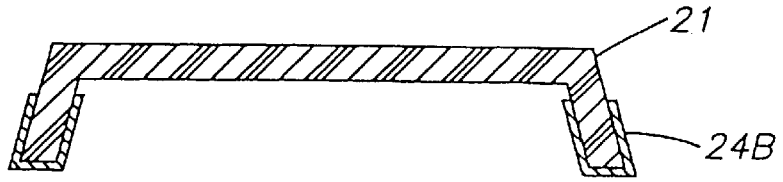
FIG. 4 is a cross-sectional view similar to FIG. 2 of another alternate embodiment of a skirt.

Some alternative embodiments include the following alternatives. Areas of the body could be masked off, rather than laser scribed, for areas of the body that you do not want to have chrome plated. Another alternative could include chrome plating the entire skirt and electrically insulating all necessary electrical components to comply with regulatory requirements. FIG. 3 shows a cross-sectional view of such an alternate embodiment wherein the body 21 has a chrome plating 24*a* on the entire skirt. A metal shell could be used and fixedly attached on the skirt body. Rather than chrome plating, the skirt body could be sprayed with a high temperature silver or metal-looking paint that is electrically non-conductive. FIG. 4 shows a cross-sectional view of such an alternate embodiment wherein the body 21 has a sprayed or dipped layer of electrically non-conductive paint 24*b*.

Figure 5A:
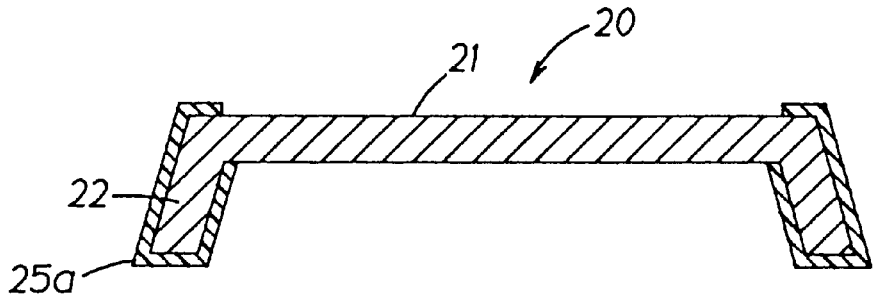
FIGS. 5*a*–5*c* are cross-sectional views similar to FIG. 2 illustrating an alternate method of manufacturing for a skirt.
Figure 5B:
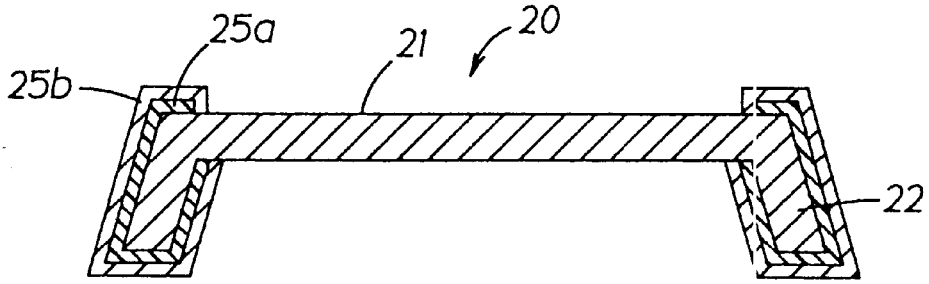
Figure 5C:
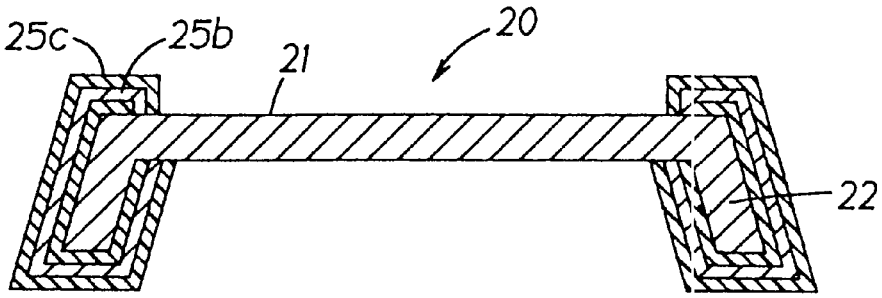

FIGS. 5*a*–5*c* illustrate a further alternate embodiment wherein a vacuum metalizing process is used to deposit a metal such as aluminum on body member 21 of skirt 20. Initially, as illustrated in FIG. 5*a,* a base coat 25*a* is applied to rim 22 of body member 21. The base coat is preferably a high temperature reflector urethane resin, identified by Redspot Paint & Varnish Co., Inc. as resin SM2113R2. The top and bottom surfaces of member 21 are preferably masked so that only rim 22 is coated. The base coated skirt is baked at an elevated temperature to dry and cure the coating. The baking temperature is within a range of 250°–300° F. and preferably is about 275° F. The baking time is about 2 hours.

After baking and curing, a metal 25*b* is deposited on the coated rim 22. The metal is preferably aluminum and is deposited via a standard vacuum metalizing process.

A urethane top coat 25*c* is then sprayed or otherwise deposited on the coated rim 22. The skirt is then rebaked at an elevated temperature to dry and cure the top coat. The baking temperature is within a range of 155–190° F. and preferably is about 170° F. The baking time is about one hour.

It should be understood that the foregoing description is only illustrative of the invention. Various alternatives and modifications can be devised by those skilled in the art without departing from the scope of the invention. Accordingly, the present invention is intended to embrace all such alternatives, modifications and variances which fall within the scope of the appended claims.

What is claimed is:

1. A method of manufacturing a skirt for an iron, the skirt having a rim portion, and top and bottom surfaces joined by the rim portion, the method comprising the steps of:

applying a base coat to at least the rim portion of the skirt;

baking the base coated skirt at an elevated temperature in the range of substantially 250–300° F. for a period of time to cure and dry the skirt;

depositing a metal layer via a vacuum metalizing process on the coated rim of the skirt;

applying a top coat on the metal layer; and baking the top coated skirt at an elevated temperature in the range of substantially 155–190° F. for a period of time to cure and dry the top coated skirt.

2. A method in accordance with claim 1 wherein the metal is aluminum.

3. A method in accordance with claim 2 wherein the base coat drying temperature is substantially 275° F.

4. A method in accordance with claim 3 wherein the baking time for the base coat is substantially 2 hours.

5. A method in accordance with claim 4 wherein the top coat drying temperature is substantially 170° F.

6. A method in accordance with claim 5 wherein the baking time for the top coat is substantially one hour.

7. A method in accordance with claim 6 wherein the base coat is made from a urethane resin.

8. A method in accordance with claim 7 wherein the top coat is made from a urethane resin.

9. A method in accordance with claim 1 wherein the base coat drying temperature is substantially 275° F.

10. A method in accordance with claim 9 wherein the top coat drying temperature is substantially 170° F.

11. A method in accordance with claim 1 wherein the top coat drying temperature is substantially 170° F.

* * * * *